United States Patent [19]

Coleman

[11] 3,982,345

[45] Sept. 28, 1976

[54] DISPLAY DEVICE WITH FLEXIBLE FACE

[76] Inventor: Kelly R. Coleman, 2367 Anna Ave., Clearwater, Fla. 33515

[22] Filed: May 23, 1975

[21] Appl. No.: 580,517

Related U.S. Application Data

[63] Continuation of Ser. No. 317,512, Dec. 22, 1972, abandoned.

[52] U.S. Cl. ..... 40/132 R; 38/102.91; 40/125 G; 160/378

[51] Int. Cl.[2] ..... G09F 13/04

[58] Field of Search ..... 40/125 G, 125 F, 156, 40/129 C, 129 R, 125 R, 128, 125 H, 82–85, 87, 88, 132 R; 38/102.5, 102.6, 102.7, 102.91; 160/378, 394

[56] References Cited

UNITED STATES PATENTS

| | | | |
|---|---|---|---|
| 454,005 | 6/1891 | Parsons et al. | 160/378 X |
| 1,475,977 | 12/1923 | West | 40/132 R X |
| 1,535,408 | 4/1925 | Fricke | 40/125 G X |
| 1,666,550 | 4/1928 | Butler | 40/87 |
| 2,947,101 | 8/1960 | Barry | 40/88 X |
| 3,226,861 | 1/1966 | Bird | 160/378 |
| 3,255,725 | 6/1966 | Von Kreidner et al. | 40/125 G X |
| 3,482,343 | 12/1969 | Hamu | 38/102.5 |
| 3,601,912 | 8/1971 | Dubbs | 38/102.91 |
| 3,726,035 | 4/1973 | Bower et al. | 40/125 G |
| 3,762,080 | 10/1973 | Poole | 38/102.91 |

*Primary Examiner*—John F. Pitrelli
*Attorney, Agent, or Firm*—Cushman, Darby & Cushman

[57] ABSTRACT

A display device including a display means which is in the form of one or more display faces made from a substantially flexible polymer and which is mounted on a frame about its peripheral portions such that sufficient or a predetermined amount of tension is placed on the face so as to at least somewhat resemble a rigid plate or face. Tensioning means may be attached to the face in opposed relation to one another and these tensioning means may be in the form of connecting means serving to interconnect the face to the frame while at the same time placing the desired amount of tension thereon. The display device may be interiorly lighted by providing a lighting assembly on the interior of the frame adjacent to the flexible face so as to transmit light thereto and clearly display any indicia formed on the face. The connecting means may comprise connector assemblies at least some of which are rotationally mounted relative to the frame and to the display face such that the amount of tension placed on the face may be regulated by the engagement of this connector assembly with the peripheral portion of the face.

1 Claim, 10 Drawing Figures

FIG. 1
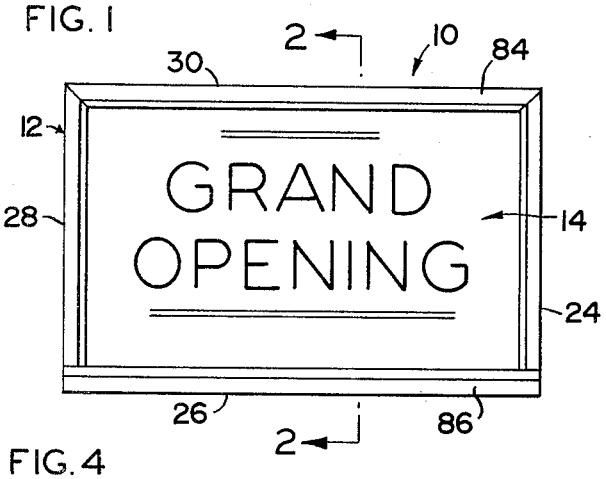
FIG. 2
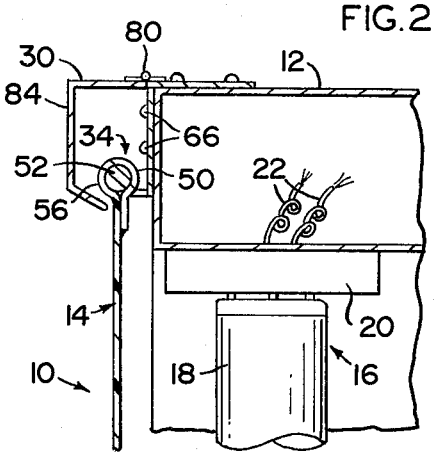
FIG. 4
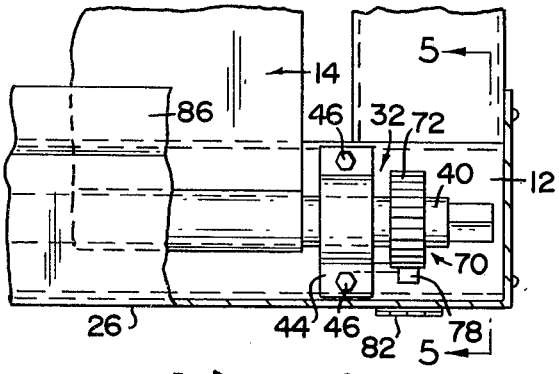
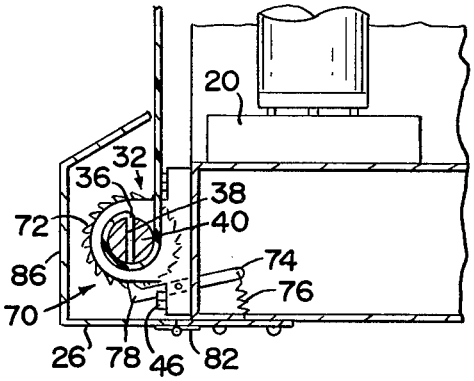
FIG. 5
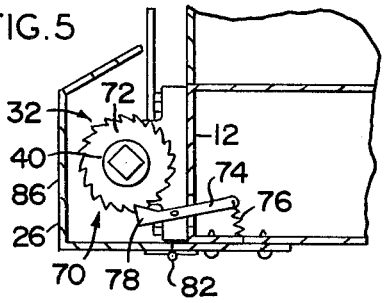
FIG. 3
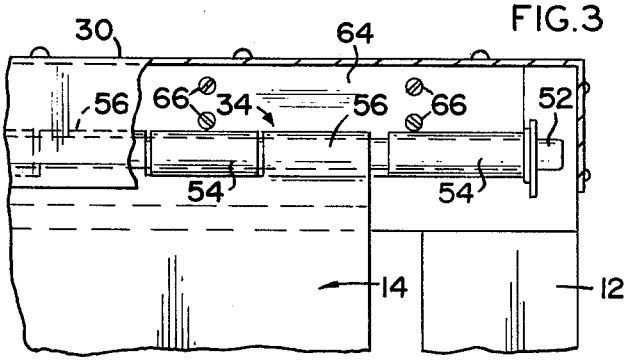
FIG. 6
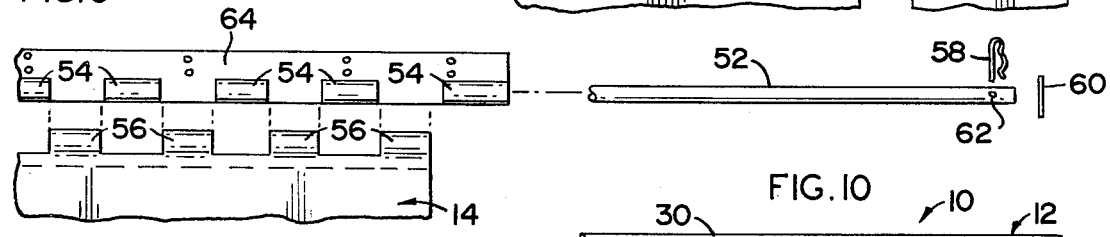
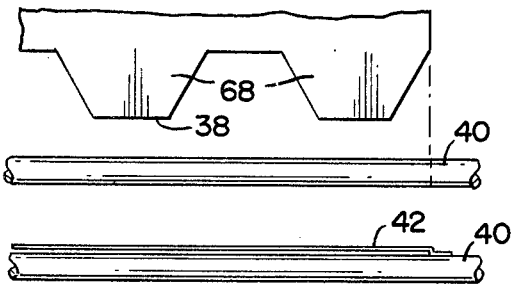
FIG. 7
FIG. 10
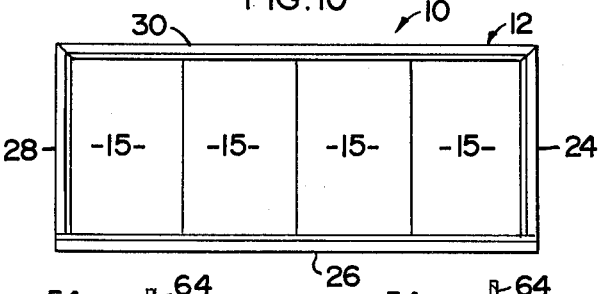
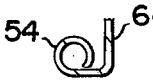
FIG. 8
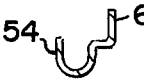
FIG. 9

DISPLAY DEVICE WITH FLEXIBLE FACE

This is a continuation, of application Ser. No. 317,512 filed Dec. 22, 1972, now abandoned.

DESCRIPTION OF THE PRIOR ART

1. Field of the Invention

A display device including one or more flexible polymer display faces having tension placed thereon by virtue of tensioning means and/or connectors attaching the display face to a supporting frame wherein indicia may be formed on the display face.

2. Detailed Description

In the advertising industry, the use of various types of display devices including those being interiorly illuminated and which are either permanently or temporarily mounted at a given location are, of course, very well known in the art. The particular configuration or construction of the sign utilized in any given advertising application depends upon such things as type of business, goods or services being advertised, location in which the sign or display device is to be located and the particular segement of the public to which the advertisement is directed. Because of these many diverse applications there is, of course, a demand for various types of signs. This demand for such a wide variety of sign structures necessarily raises the cost of production and also that of maintenance since many of the signs utilized today have to be made to individual specifications.

Other disadvantages inherent in the production and use of custom made signs include the cost involved of installing these signs which frequently equals or exceeds the actual production cost. Since up to the present time no one single sign structure has had the versatility to satisfy the wide variety of advertising needs, the installation of the varying sign structures would also have to be done on a custom installation type basis. Since a custom built sign was normally utilized and adapted to a particular location and application workers involved in installing these custom made structures would often times be dealing with completely different types of structures of which they had no general knowledge or experience. Because of the above factors, the time and expense involved in installing these prior art sign structures is relatively great.

Large scale or mass production of a substantially standard display device capable of being applied to various uses is, of course highly desirable in that this type of manufacturing serves to lower the cost of production. Maintenance of a standard type sign will also be less expensive since repair or servicing of such a sign could be done on a replacement part type basis. However, as pointed out above, the diverse application for which these signs are needed and used normally would prevent a sign structure from being mass produced. For this reason, mass production of a generally standard type sign, which is to be effective for various applications, has been relatively unknown in the advertising industry. In devising production methods for producing such signs, labor, production time and necessary equipment are all prime factors. In addition, the ultimate appearance of the sign itself must always be kept in mind.

One of the most important structural features of any sign is of course, the display face used for advertising of the various services or goods. Naturally, the display face itself is what is primarily observed by the public. It can therefore be seen that the production of a display face which would be adapted to fit various sign structures and which itself is aesthetically pleasing yet eye catching, could greatly reduce the cost of "customized" sign structures. Such face, if available, could be applied to almost any of the conventionally designed prior art structures available today.

Because of these and other commonly known problems prevalent in the advertising and sign making industry, there has been a long felt need for a display device incorporating a display face which is versatile enough to be adapted to a number of various advertising structures. At the same time, such a display device and display face structure must include a relatively simple, low cost construction capable of being easily maintained and transported to and given location. Ideally, such a sign structure would be of somewhat standard type construction which is capable of being built through the application of mass production techniques. In addition, the versatility of such a structure would include its being readily used for various application while at the same time being capable of efficiently and aesthetically advertising any desired subject matter.

SUMMARY OF THE INVENTION

The present invention is directed to a display device comprising a frame means which may be interiorly lighted by virtue of any conventional lighting assembly. The lighting assembly is preferably positioned in substantially adjacent relation to the rear surface of a display face for transmitting light therethrough and rendering any indicia formed on the face, readily obvious.

The face itself is formed from a substantially flexible polymer such as polyvinyl chloride (PVC) and is connected to the frame along its peripheral portions. Tensioning means are provided which may comprise the connecting means itself wherein the tensioning means are located in opposed relation to one another. While other flexible polymeric material can be utilized other than PVC, it has been found through actual application and testing, that polyvinyl chloride is well suited for the use herein described and is accordingly preferred. More specifically, when the connecting means comprises the tensioning means, the connecting means includes a plurality of connector assemblies. At least two of the connector assemblies may be mounted in opposed relation to one another and at least one of these two assemblies may be rotationally mounted relative to both the frame and the peripheral portion of the face which it engages. The opposite of the connector assembly may be substantially fixedly mounted to the frame so as to hold or secure the opposite peripheral portion of the face in substantially fixed position relative to the peripheral portion of the frame on which it is mounted. Therefore, in this particular embodiment or rotation or movement of the one connector assembly causes a "rapping" of the peripheral portion which it engages about the connector assemblies. This serves to place tension on the face itself thereby making it substantially rigid, since the opposite portion of the face is held in place by the opposite connector assembly. Rigid, in the sense used herein, means substantially rigid in the sense of rigidity, normally identified with the skin or membrane used for drums or similar percussion type musical instruments.

One embodiment of the present invention comprises the display face including a single sheet dimensioned to extend across the entire display opening of the frame.

This single sheet has its major peripheral portions attached to the peripheral portions of the frame by virtue of the tensioning or connecting means. When this embodiment is utilized, at least four connector assemblies may be utilized, each of which is positioned in opposed relation to at least one other. Furthermore, at least three of the four connector assemblies may be of the rotational shaft type previously discussed wherein a shaft is rotatably mounted along a peripheral portion of the frame and configured to engage a peripheral portion of the display face. Again, rotation of the shaft causes the peripheral portion which it engages to wrap therearound causing tension to be placed on the face due to another connector assembly mounted in opposed relation thereto on the opposite end of the frame and which engages an opposite portion of the face. In this embodiment, at least two of the rotatably mounted connector assemblies are arranged in opposed relation to one another and a third may be rotationally mounted relative to a fixed connector assembly, as described above, or a fourth rotationally mounted connector assembly.

Locking means in the form of a ratchet assembly is connected to the movably or rotatably mounted connector assembly so as to allow rotation of the assembly in one direction and prevent or restrict its rotation in the other thereby preventing the display face from becoming "unravelled". The rotating shaft formed as part of the rotatably mounted connector assembly may have slot means specifically attached thereto or formed thereon and configured to engage a specifically configured peripheral portion of the display face. More specifically the display face may include a peripheral portion comprising a plural of tongue means arranged in spaced relation to one another wherein each of the tongue means may be attached directly to the slot means formed on the shaft. The connector assembly which is relatively fixed may include a plurality of channels or grooves configured to have mounted therein a support rod. The peripheral portion of the display face designed to engage this connector assembly may also include corresponding channels or grooves formed therein such that the support rods may engage the fixed connector assembly and the grooves or channels of the peripheral portion of the display face so as to be supported by the fixed connector assembly and to support the display face in relatively fixed position.

Another embodiment of the present invention may include the display means including a plurality of display faces arranged in side by side, adjacent relation to one another wherein opposed peripheral portions of each of the display faces are connected to the frame and are thereby tensioned to be substantially "rigid" in the sense described above. Again, the connecting means, which may form part of the tensioning means may include opposed connector assemblies wherein either or both of the connector assemblies may be movably or rotatably mounted thereon such that the proper tension can be placed on the individual sheets which define the individual display faces. As in the embodiment described above, each of the individual sheets which form each of the individual display faces is produced from a substantially flexible polymer material.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and the objects of the invention, reference should be had to the following detailed description, taken in connection with the accompany drawing in which:

FIG. 1 is a front plan view of the display device of the present invention.

FIG. 2 is a sectional view taken along line 2—2 of FIG. 1 showing the interior of a portion of the display device including the frame means, the display face and the connecting means attached thereto.

FIG. 3 is a sectional partial cutaway view showing details of a connector assembly which comprises in part the connecting means.

FIG. 4 is a sectional partial cutaway view of a detail of a connector assembly which also comprises the connecting means.

FIG. 5 is a sectional view taken along line 5—5 of FIG. 4 showing a detail of the locking means connected to a connector assembly.

FIG. 6 is a detailed, partial cutaway view showing more than one embodiment of the connecting means of the present invention.

FIG. 7 is a detailed, partial cutaway view showing a rotating shaft as being part of the connecting means.

FIG. 8 is a sectional view showing detailed structure of the present invention.

FIG. 9 is a sectional view showing detailed structure of the present invention.

FIG. 10 is a front plan view showing another embodiment of the display means including a plurality of display faces mounted on the frame means of the present invention.

Similar reference characters refer to similar parts throughout the several views of the drawings.

DETAILED DESCRIPTION

This invention relates to a display device generally indicated as 10 in FIG. 1 which includes a frame means 12 arranged in supporting relation to a display means in the form of display face 14. As shown in FIG. 2 a lighting assembly generally indicated as 16 may be mounted on the interior of frame 12 and may include conventional type of fluorescent or incandescent bulbs 18 secured to ballast means 20 affixed directly to the frame itself as shown. Conductors 22 serve to electrically connect the ballast and therefore the bulbs 18 to any applicable power source.

Turning to the embodiment shown in FIGS. 1 and 2 the display face 14 may comprise a single sheet of substantially flexible polymeric material, such as polyvinyl chloride, dimensioned sufficient to have its peripheral portion connected to the major peripheral portions 24, 26, 28 and 30 of frame 12. Accordingly, the opposed peripheral portions of face 14 are connected to the opposed peripheral portions of frame means 12 as shown. These connecting means may also serve as tensioning means to place a sufficient or predetermined amount of tension across the face 14. As described above, this tension is sufficient to render the face substantially rigid to the degree that rigidity resembles a membrane stretched across a percussion type instrument fully discussed hereinbefore.

The connecting means may include at least two connector assemblies generally indicated as 32 and 34.

Assembly 32 is movably or rotatably mounted to the frame 12 and is positioned to engage a peripheral portion 36 of face 14. This engagement may be defined by a slot means 38 formed in rotationally mounted shafts 40 which is part of the connector assembly 32. Alternately, as shown in FIG. 7, the slot means may comprise a strap 42 secured to the outer surface of shaft 40 so as to engage the peripheral portion of face 14 which may be specifically configured as will be discussed hereinafter. As shown in FIG. 4, shaft 40 may be rotatably mounted on frame 12 by a bracket means 44 connected to frame 12 by connectors 46. A conventional bearing means may be attached to the bracket 44 so as to permit the rotational movement of shaft 40 relative thereto.

Connector assembly 34 is disposed in opposite relation to connector assembly 36 and is designed to engage in supporting relation thereto peripheral portion 50 of face 14. As shown in FIG. 6, the connector assembly 34 may comprise a support rod 52 and a plurality of loops or grooves 54 which may slidingly engage rod 52. Correspondingly shaped loops or channels 56 are formed in peripheral portions 50 of face 14 and also designed to at least partially surround or engage rod 52 so as to be supported thereby. A pin and washer assembly 58 and 60 respectively, are designed to be attached to one another and through aperture 62 so as to maintain rod 52 in fixed engagement on frame 12 when the face 14 and the channel 56 are mounted thereon. As shown in FIGS. 2 and 3, loops 54 may be integrally formed on bracket 64 which is attached to frame 12 by conventional connectors 66. Both the connector assemblies 32 and 34 may extend along substantially the entire length of peripheral portions 26 and 30 respectively or alternately along a sufficient amount of the lenght of these portions to securely affix display face 14 to the frame as intended.

As shown in FIG. 6, the peripheral portion 38 of face 14 is specifically configured to define tongue means 68 arranged in spaced relation to one another. The tongue means are configured to readily engage the slot means of 42, regardless of its embodiment, formed on or attached to shaft 40.

A locking means generally indicated as 70 is shown in FIGS. 2, 4 and 5. This locking means may be interconnected between the frame and the shaft 40 comprising the movable connector assembly. The locking means may comprise a ratchet assembly including toothed wheel 72 fixedly attached to shaft 40 and a locking arm or lever 74 attached to frame 12 and including a biasing spring 76 serving to bias locking finger 78 into engagement with the teeth along the periphery of wheel 72. Accordingly, rotation of shaft 40 is permitted in one direction thereby allowing the peripheral portion 38 to be wrapped about shaft 40. Engagement between the arm 74 and wheel 72 prevents the rotation of shaft in the opposite direction thereby preventing the unwrapping of the peripheral portion 36 from shaft 40.

A hinge means generally indicated as 80 and 82 serve to pivotally connect shield means 84 and 86 to frame 12 in such a position to at least partially enclose connector assemblies 34 and 36 respectively. Again, each of the shield means may extend along the peripheral portions 26 and 30 a sufficient degree to cover the respective connector assemblies as shown.

Another embodiment of the present invention comprises the display means being defined by a plurality of display faces 15, each of which are formed from a single sheet of substantially flexible polymeric material. As shown in FIG. 10, the sheets are arranged in side by side, adjacent relation to one another and are affixed to frame 12 along its peripheral portions 26 and 30. Connecting and/or tensioning of each of the sheets may occur through similar connector assemblies as discussed fully above. In the embodiment shown in FIG. 10, the sheets 15 are not necessarily connected to one another and various indicia may be placed thereon so as to advertise different products or any combination thereof as desired.

Also as previously discussed, various tensioning means or connector assemblies may be mounted along major peripheral portions 24 and 28 of frame 12 so as to engage the correspondingly positioned peripheral portions of face 14 associated therewith. When connector assemblies such as assembly 32 are mounted along these peripheral portions 24 and 28, rotation thereof in opposite direction causes the desired tensioning being placed on face 14, similar to that as explained with reference to the embodiment as shown in FIG. 2. It is, of course, within the scope of the present invention that the connector assembly or tensioning means may be placed only along peripheral portions 24 and 28 of frame 12 so that the sole tensioning force placed on face 14 comes from these connector assemblies.

It will thus be seen that the objects made apparent from the preceeding description, are efficiently attained and, since certain changes may be made to the above article without departing from the scope of the invention, it is intended that all matter contained in the above description or shown in the accompanying drawing shall be interpreted as illustrative and not in a limiting sense.

It is also to be understood that the following claims are intended to cover all the generic and specific features of the invention herein described, and all statements of the scope of the invention which, is a matter of language, might be said to fall therebetween.

Now that the invention has been described,

What is claimed is:

1. A display device comprising: frame means having a continuous peripheral portion surrounding an opening, display means extending across said opening, said display means including a flexible translucent sheet of synthetic polymeric material having indicia thereon, means for applying adjustable tensioning force to said sheet in a first direction in the plane of said sheet and means for applying adjustable tensioning force to said sheet in a second direction in the plane of said sheet and perpendicular to said first direction in order to impart rigidity thereto, each of said means including connecting means supported by said frame means and connected to a pair of oppositely disposed edges of said sheet, and a lighting assembly supported within said frame means and located relative to said sheet so as to transmit light therethrough, including four shield means each of which is adjustably mounted on said frame means for swinging movement between a first position in which it covers one of the connecting means associated with an edge of said sheet and a second position in which the respective connecting means is uncovered.

* * * * *